US007959467B2

(12) United States Patent
Sasser et al.

(10) Patent No.: US 7,959,467 B2
(45) Date of Patent: Jun. 14, 2011

(54) COMMUNICATION MODULE GROUND CONTACT

(75) Inventors: Gary D. Sasser, San Jose, CA (US); Chris Togami, San Jose, CA (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 12/611,843

(22) Filed: Nov. 3, 2009

(65) Prior Publication Data

US 2010/0112861 A1 May 6, 2010

Related U.S. Application Data

(60) Provisional application No. 61/110,850, filed on Nov. 3, 2008.

(51) Int. Cl.
*H01R 13/648* (2006.01)

(52) U.S. Cl. ..... 439/607.19; 439/95; 439/939

(58) Field of Classification Search ..... 439/607.19, 439/607.01, 607.02, 676, 95, 939
See application file for complete search history.

(56) References Cited

U.S. PATENT DOCUMENTS

2004/0161958 A1 8/2004 Togami et al.
2007/0059953 A1 3/2007 Togami et al.
2007/0149005 A1 6/2007 Togami et al.
2007/0224851 A1 * 9/2007 Togami et al. ..... 439/76.1
2008/0248694 A1 10/2008 Togami et al.

OTHER PUBLICATIONS

International Search Report and Written Opinion mailed Jun. 22, 2010 in connection with corresponding International Application No. PCT/US2009/063176.

* cited by examiner

*Primary Examiner* — Javaid Nasri
(74) *Attorney, Agent, or Firm* — Maschoff Gilmore & Israelsen

(57) ABSTRACT

A transceiver module that utilizes a side contact spring portion to ground a shielded cable that is plugged into the transceiver module. In one example embodiment, a transceiver module includes a housing, a jack, and a side contact spring portion. The housing is operative to be electrically connected to chassis ground when the transceiver module is received within a host port. The jack is defined in the housing and operative to receive a shielded plug. The side contact spring portion is substantially implemented within the jack and is configured to be in electrical contact with both the housing and a conductive element of the shielded plug received by the jack such that a chassis ground is established between the housing and the shielded plug and such that a moveable bail pivot lever is able to move without disrupting the electrical contact between the side contact spring portion and the housing and/or the conductive element of the shielded plug.

15 Claims, 5 Drawing Sheets

COMMUNICATION MODULE GROUND CONTACT

CROSS-REFERENCE TO RELATED APPLICATIONS

This application claims the benefit of U.S. Provisional Patent Application Ser. No. 61/110,850, filed Nov. 3, 2008, which is incorporated herein in its entirety by this reference.

BACKGROUND

Communication modules, such as copper transceiver modules, often include a jack that can receive a corresponding plug. Examples of jack and plug configurations include, but are not limited to, jacks and plugs compliant with registered jack ("RJ") standards such as RJ-11, RJ-14, RJ-25, RJ-45, RJ-48, and RJ-61 standards. The RJ-45 standard is commonly used in conjunction with copper communications cables. Examples of copper communications cables include, but are not limited to, Category 5 ("CAT-5") cables, CAT-5e cables, and CAT-6 cables.

Copper communications cables can also be shielded. A shielded copper communications cable can be used in environments where there exists a need to eliminate interference from other electronic sources in order to enable clear signal transmission. Shielded copper communications cables typically terminate with a shielded plug. A shielded plug includes one or more exposed grounding electrical conductors. These exposed grounding electrical conductors are configured to be electrically grounded to chassis ground when inserted into a jack of a copper transceiver module.

One challenge with shielded plugs involves providing a reliable chassis ground contact for the shielded plug within the jack of the transceiver module. In particular, plugs and jacks are subject to wear and tear over time due to friction between plugs and jacks as the plugs are inserted into and removed from the jacks. This wear and tear can cause the exposed grounding electrical conductors of a shielded plug to become damaged. Likewise, such wear and tear can cause corresponding chassis-grounded electrical conductors of a jack to become damaged. This damage to the grounding electrical conductors of a shielded plug and/or jack can cause the chassis ground connection provided to the shielded plug to degrade into an intermittent and/or unreliable connection.

Plugs and jacks also occasionally suffer from mutual dimensional variations. For example, a particular plug may have a width that is slightly less than the standard width and a particular jack may have a width that is slightly greater than the standard width. In this example, when this plug is inserted into this jack, grounding electrical conductors on the outside sides of the plug and chassis-grounded electrical conductors on the inside sides of the jack may make only intermittent and/or unreliable mutual electrical contact, which can cause the chassis ground provided to the shielded plug to be intermittent and/or unreliable.

In light of the above discussion, a need currently exists for a transceiver module that is configured to provide a grounded connection with a shielded cable that is plugged into the transceiver module. In particular, there is a need for a transceiver module that is configured to provide a constant and reliable grounded connection with a shielded cable that is plugged into the transceiver module, thereby ensuring proper operation of the transceiver module.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In general, embodiments of the invention are concerned with a transceiver module, such as a copper transceiver module, that utilizes a side contact spring portion to ground a shielded cable that is plugged into the transceiver module.

In one example embodiment, a transceiver module includes a housing operative to be electrically connected to chassis ground when the transceiver module is received within a host port, a jack defined in the housing and operative to receive a shielded plug, and a side contact spring portion substantially implemented within the jack, wherein the side contact spring portion is configured to be in electrical contact with both the housing and a conductive element of the shielded plug received by the jack such that a chassis ground is established between the housing and the shielded plug and such that a moveable bail pivot lever connected to a locking member and configured to allow the removal of the transceiver module from within the host port is able to move without disrupting the electrical contact between the side contact spring portion and the housing and/or the conductive element of the shielded plug.

In another example embodiment, a transceiver module includes a housing comprising electrically conductive material, a jack defined in the housing, the jack being configured to receive a shielded plug, a wire bail at least partially enclosed in the housing, and a side contact spring portion substantially implemented within the jack, wherein the side contact spring portion is configured to electrically connect with the housing, the wire bail, and the shielded plug that is received within the jack.

In yet another example embodiment, a transceiver module includes a housing comprising electrically conductive material, a jack defined in the housing, the jack being configured to receive a shielded plug, a latch mechanism at least partially enclosed within the housing, the latch mechanism comprising: a mounting plate electrically connected to the housing, a pivot block pivotally and electrically connected to the mounting plate, and a wire bail operatively and electrically connected to the pivot plate, and a side contact spring portion substantially implemented within the jack, wherein the side contact spring portion is configured to electrically connect with the housing, the wire bail, and the shielded plug that is received within the jack Additional features and advantages will be set forth in the description which follows, and in part will be obvious from the description, or may be learned by the practice of the teaching herein. The features and advantages of the teaching herein may be realized and obtained by means of the instruments and combinations particularly pointed out in the appended claims. These and other features will become more fully apparent from the following description and appended claims, or may be learned by the practice of the invention as set forth hereinafter.

BRIEF DESCRIPTION OF THE DRAWINGS

To further clarify aspects of the present invention, a more particular description of the invention will be rendered by reference to specific embodiments thereof which are disclosed in the appended drawings. It is appreciated that these drawings depict only example embodiments of the invention and are therefore not to be considered limiting of its scope.

The invention will be described and explained with additional specificity and detail through the use of the accompanying drawings in which.

DETAILED DESCRIPTION

Example embodiments of the present invention relate to a transceiver module, such as a copper transceiver module, that utilizes a side contact spring portion to ground a shielded cable that is plugged into the transceiver module. While described in the context of copper transceiver modules used in the field of communications networking, it will be appreciated that example embodiments of the present invention are applicable to other applications as well. For example, other types of transceiver modules, both electronic and opto-electronic, could utilize embodiments of the wire bail latch for providing a reliable ground to a shielded plug of a shielded cable.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

In the following description, numerous specific details are set forth in order to provide a thorough understanding of example embodiments of the present invention. It will be obvious, however, to one skilled in the art that the example embodiments of the present invention may be practiced without these specific details. In other instances, well-known aspects of transceiver modules have not been described in great detail in order to avoid unnecessarily obscuring the example embodiments of the present invention.

I. Example Transceiver Module

Figure 1:
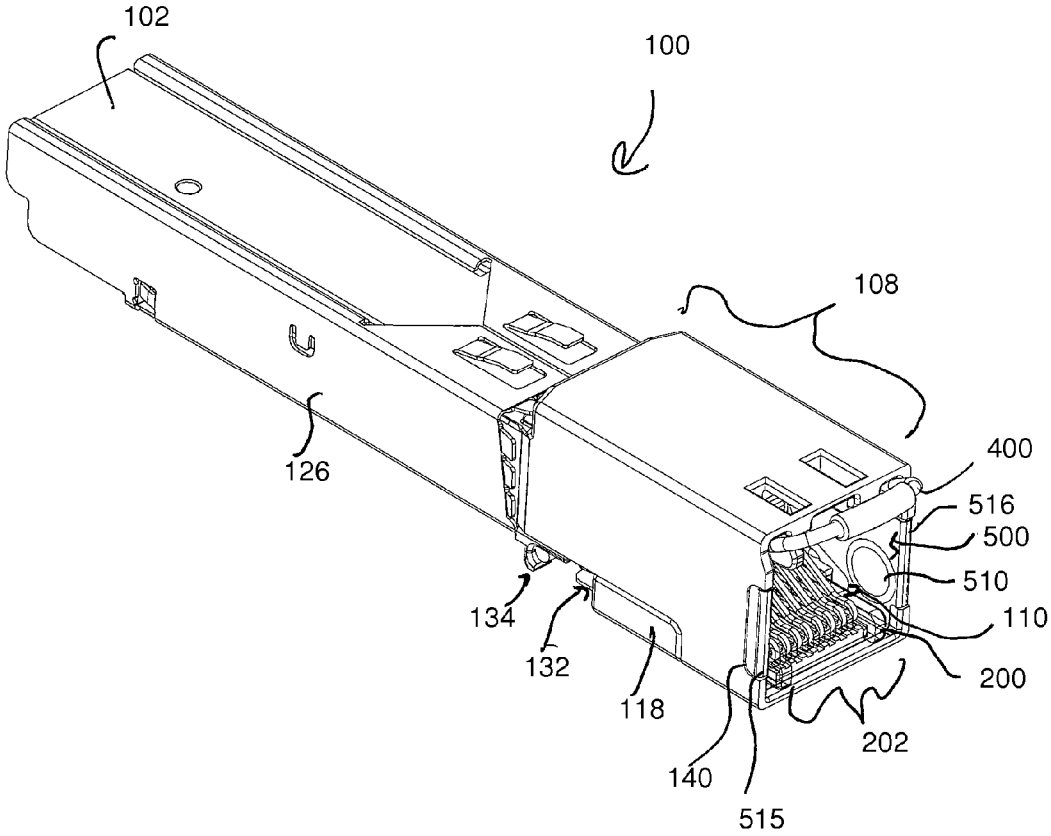
FIG. 1 is a perspective view of one example embodiment of an assembled transceiver module.
Figure 2:
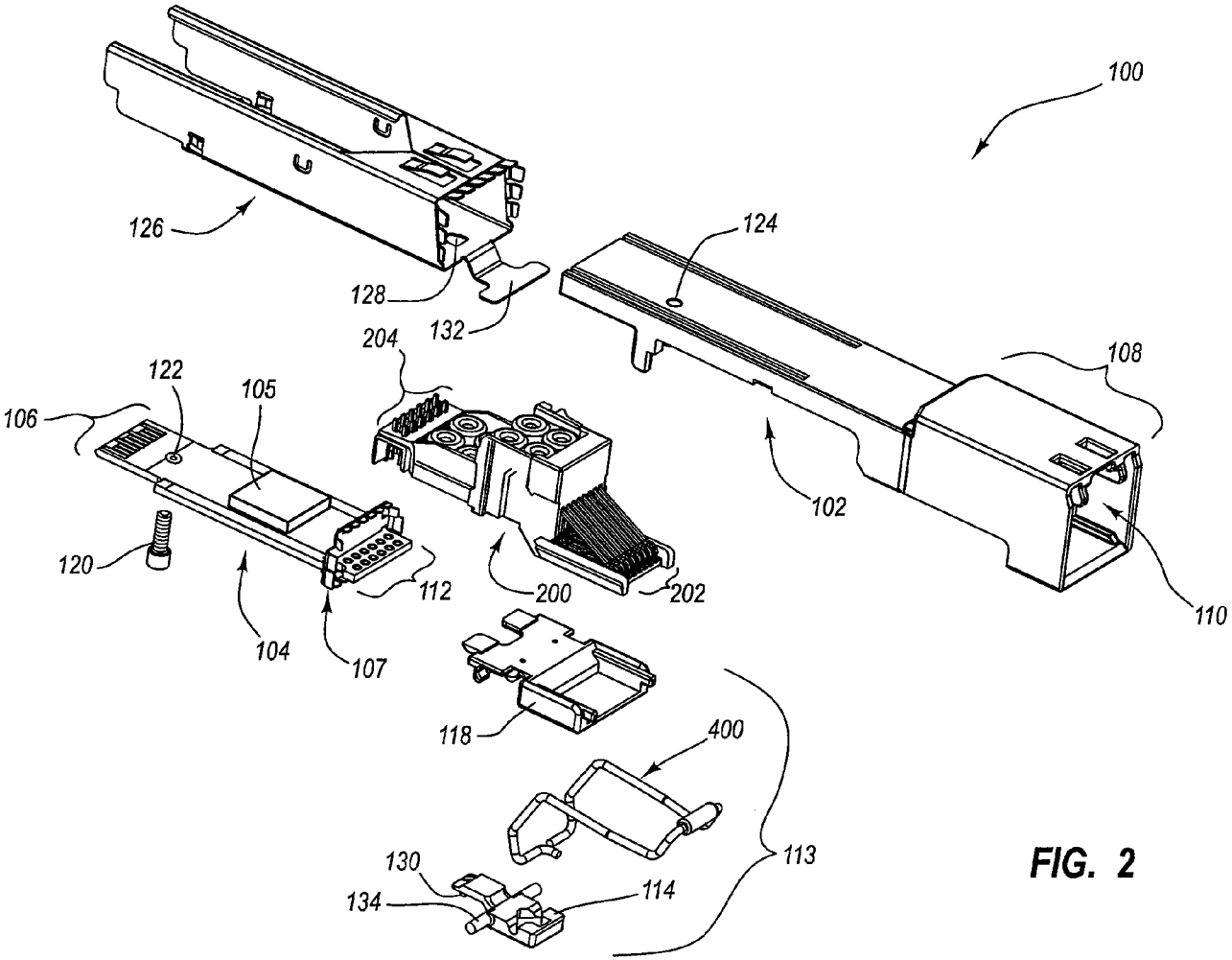
FIG. 2 is an exploded perspective view of the transceiver module of FIG. 1.

Reference is first made to FIGS. 1 and 2 together, which disclose perspective views of one example embodiment of a copper transceiver module, designated generally at 100. The transceiver module 100 has a low profile and substantially complies with existing industry standards, including transceiver module form factor, specified in the Small Form-factor Pluggable (SFP) Transceiver MultiSource Agreement (MSA). The transceiver module 100 achieves data rates of 1.25 Gb/s, supports the 1000 Base-T transmission standard (also known as the IEEE 802.3ab standard), operates between about −40° C. and about 85° C., and is pluggable. Aspects of example embodiments of the present invention can be implemented in transceiver modules having other data rates, transmission standards, and/or operating temperatures. Likewise, aspects of example embodiments of the present invention can be implemented in transceiver or other communication modules that are not pluggable.

In the disclosed example, the transceiver module 100 includes an elongated base, designated generally at 102, that is configured to support and retain a first printed circuit board 104. In this example, the printed circuit board 104 accommodates various electronic components 105 positioned thereon, and it can include differing components and circuitry configurations, depending on the type of transceiver module in which it is implemented. Also formed on the printed circuit board 104 at a rear end is an exposed edge connector 106. The edge connector 106 is configured to be electrically compatible with a corresponding electrical connector (not shown) that is positioned within the port of a host device (not shown). Other connector schemes that are well known in the art could also be used in the transceiver module 100. In addition, as disclosed in FIG. 2, the transceiver module 100 includes an EMI shield 107 that is configured so as to circumscribe a portion of the printed circuit board 104.

In the disclosed example embodiment, a connector portion, designated generally at 108, is positioned at one end of the base 102 of the transceiver module 100. The connector portion 108 defines an RJ-45 jack 110 that is configured to operatively receive a corresponding RJ-45 plug, such as the RJ-45 plug shown in FIGS. 3A and 3B. Other examples of jack and plug configurations include, but are not limited to, jacks and plugs compliant with registered jack ("RJ") standards such as RJ-11, RJ-14, RJ-25, RJ-48, and RJ-61 standards. The RJ-45 standard is commonly used in conjunction with copper communications cables. Examples of copper communications cables include, but are not limited to, Category 5 ("CAT-5") cables, CAT-5e cables, and CAT-6 cables. It will be appreciated that the jack 110 could be implemented to accommodate any one of a number of different connector configurations, depending on the particular application involved.

The transceiver module 100 further includes a connector structure 200. The connector structure 200 fits within the connector portion 108 of the base 102. The connector structure 200 includes a first plurality of conductive elements 202 that are configured to make electrical connection to a corresponding plurality of electrical elements on an RJ-45 plug when the RJ-45 plug is inserted into the RJ-45 jack 110. The connector structure 200 also includes a second plurality of conductive elements 204 that are configured to electrically connect with a corresponding plurality of plated through holes 112 on the printed circuit board 104.

Figure 3B:
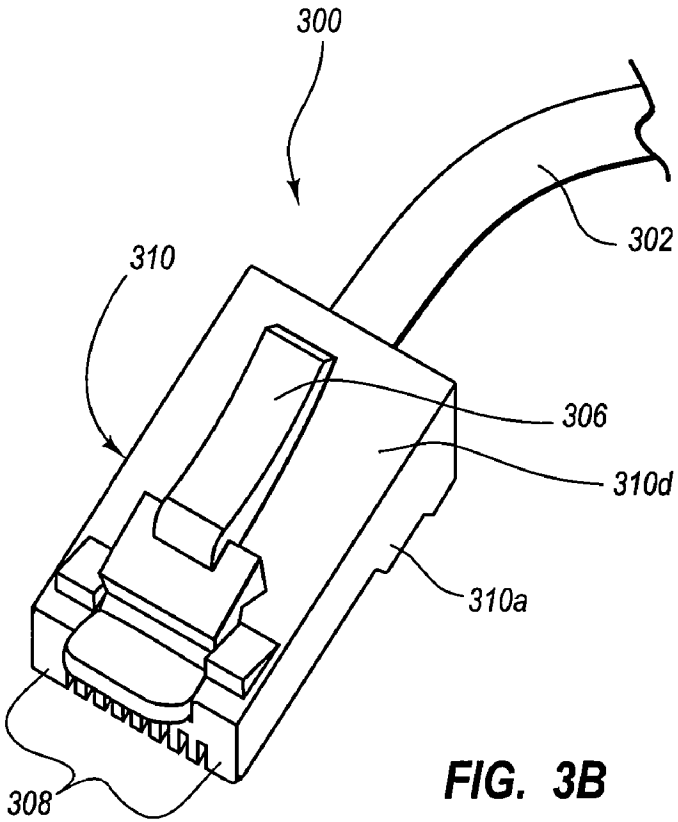
FIG. 3B is a top perspective view of the example shielded plug of FIG. 3A.
Figure 3A:
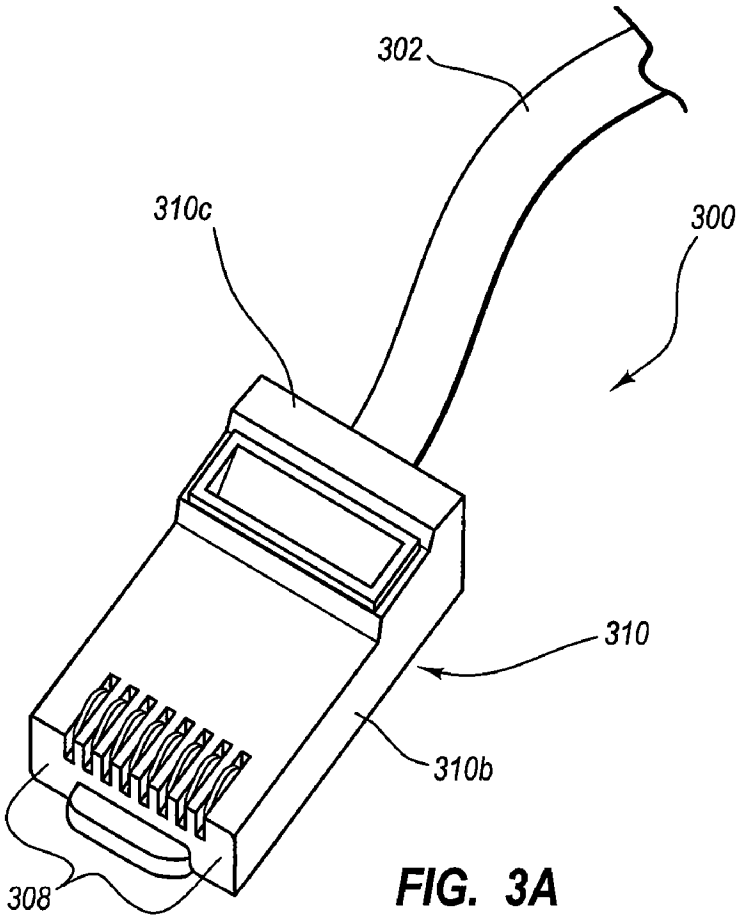
FIG. 3A is a bottom perspective view of an example shielded plug.

The transceiver module 100 also includes a latch mechanism 113, which is made up of a pivot block 114, a bail 400, and a mounting plate 118. In one example embodiment, the latch mechanism 113 provides several functions. First, the latch mechanism 113 provides a mechanism for "latching" the transceiver module 100 within a host port (not shown) when the transceiver module 100 is operatively received within the host port. Moreover, the latch mechanism 113 also provides a convenient means for extracting the transceiver module 100 from the host port, without the need for a special extraction tool. The latch mechanism 113 is preferably implemented so as to substantially preserve the small form factor of the transceiver module 100 in accordance with prevailing standards, and in a manner that allows convenient insertion and extraction of the transceiver module 100 from a host port without disturbing adjacent transceiver modules or adjacent copper communications cables—even when used in a host having a high port density. Also, in an example embodiment, the latch mechanism 113 precludes inadvertent extraction of the transceiver module 100 from the host port when an RJ-45 plug, such as the plug disclosed herein in connection with FIGS. 3A and 3B, is operatively received within or removed from the RJ-45 jack 110.

The mounting plate 118 includes mounting and pivot components for use in operatively interconnecting the pivot block 114, the bail 400 and the transceiver module 100. The function of the pivot block 114 and the bail 400 with respect to the mounting plate 118 within the transceiver module 100 is substantially similar to the function and operation of a pivot block 310 and a bail 308 with respect to a mounting plate 314 within a module 300 as disclosed in connection with FIGS. 5 and 6 of U.S. Patent Application Publication No. "2004/0161958 A1" titled "Electronic Modules Having Integrated Lever-Activated Latching Mechanisms," published Aug. 19, 2004, which is incorporated herein by reference in its entirety. More particularly, the bail 400 functions as a pivot lever in its interaction with the pivot block 114 and the mounting plate 118.

FIGS. 1 and 2 disclose how the base 102 and the printed circuit board 104 are at least partially enclosed and retained within a housing, designated generally at 126. The housing 126 is generally rectangular in cross-sectional shape so as to accommodate the base 102. The housing 126 includes an opening at its rear end so as to expose the edge connector 106 and thereby permit it to be operatively received within a corresponding electrical connector slot (not shown) within a host port of a host device (not shown). In one example embodiment, the housing 126 is formed of a conductive material such as sheet metal.

In an example embodiment, the housing 126 is configured so as to accommodate the latch mechanism 113 of the transceiver module 100. For example, a bottom surface of the housing 126 includes a locking recess 128, which is sized and shaped to expose a lock pin 130 of the pivot block 114 when the latch mechanism 113 is assembled within the transceiver module 100 and is in a latched position. Also, the housing 126 includes a means for biasing the latch mechanism 113 to a latched position. By way of example, the biasing means can be a resilient metal portion of the housing 126 that is formed as a leaf spring 132. When the transceiver module 100 is operably assembled, the leaf spring 132 can be biased against a top surface of the pivot block 114 so as to operatively secure the pivot block 114 in its assembled position. Also, the biasing action can be applied so as to urge the pivot block 114 in a rotational direction about a pivot point 134 so as to expose the lock pin 130 through the locking recess 128, which corresponds to the transceiver module 100 being in a latched position.

In addition, as disclosed in FIGS. 1 and 2, after the connector structure 200 is operably connected to the printed circuit board 104 and operably assembled within the base 102, the mounting plate 118 partially encloses the connector structure 200 within the connector portion 108 of the base 102. The mounting plate 118 can be made from an electrically conductive material, as can the pivot block 114 and the base 102. Therefore, after the assembly of the transceiver module 100, when the base 102 is grounded, for example to chassis ground, the mounting plate 118 is also necessarily grounded because of the secure electrical attachment of the mounting plate 118 to the connector portion 108 of the base 102. In addition, because of the secure electrical attachment of the pivot block 114 to the mounting plate 118, the pivot block 114 is also necessarily grounded. Additionally, where the housing 126 is chassis-grounded, the biasing of the leaf spring 132 of the housing 126 against the pivot block 114 provides another grounding contact for the pivot block 114. The printed circuit board 104 is also secured to the base 102 with a fastener 120 which passes through an opening 122 in the printed circuit board 104 and into an opening 124 in the base 102.

II. Example Shielded Plug

Reference is now made to FIGS. 3A and 3B, which are a bottom perspective view and a top perspective view, respectively, of an example shielded plug 300. The shielded plug 300 is sized and configured to be inserted into the jack 110 disclosed in connection with FIG. 1. The shielded plug 300 is included at an end of a shielded cable 302, which as disclosed herein, can be any of, but is not limited to, a CAT-5 shielded cable, a CAT-5e shielded cable, or a CAT-6 shielded cable. The shielded plug 300 also includes a plastic clip 306. The clip 306 is configured to automatically lock the shielded plug 300 in place when the shielded plug 300 is inserted into the jack 110. Pressing down on the clip 306 when the shielded plug 300 is positioned within the jack 110 unlocks the shielded plug 300 from the jack 110 and enables the shielded plug 300 to be removed from the jack 110.

The shielded plug 300 also includes conductive elements 308. The conductive elements 308 of the shielded plug 300 correspond to the conductive elements 202 of the connector structure 200. When the shielded plug 300 is inserted into the jack 110, the conductive elements 308 of the shielded plug 300 are in electrical contact with the conductive elements 202 of the connector structure 200, thereby providing an electrical connection between the shielded cable 302 and the connector structure 200 over which electrical signals can travel.

The shielded plug 300 also includes an electrically conductive housing 310. The electrically conductive housing 310 is made up of several sections including side sections 310*a* and 310*b*, a bottom section 310*c*, and a top section 310*d*. Each of the sections 310*a*-310*d* of the electrically conductive housing 310 is in electrical contact with the other sections of the electrically conductive housing 310. The electrically conductive housing 310 is designed to make electrical contact with a corresponding chassis-grounded conductive element of the transceiver module 100 when the shielded plug 300 is inserted into the jack 110 of the transceiver module 100. In order for the shielded plug 300 and the shielded cable 302 to function properly, the electrical contact between the electrically conductive housing 310 and the corresponding chassis-grounded conductive element of the transceiver module 100 must be reliable and constant.

III. Example Side Contact Spring Portion

Reference is again made to FIG. 1, which further illustrates that module 100 includes a side contact spring portion 500 that can function to provide a chassis ground contact to a shielded plug, such as the shielded plug 300 of FIGS. 3A and 3B, that is inserted into the jack 110. As shown, the side contact spring portion 500 is placed in the interior of the jack 110 as will be explained in more detail to follow.

As also illustrated in FIG. 1, the side contact spring portion 500 includes compression fingers 515 and 516 and a raised portion 510. The compression fingers function to provide a compression connection with the outer shell of connector portion 108. As shown, connector portion 108 includes a recess 140 that receives the compression finger 515 to thereby provide the compression contact. Although not illustrated, connector portion 108 also includes a second recess on the side opposite the recess 140 for receiving compression finger 516 to thereby provide the compression contact.

Figure 4:
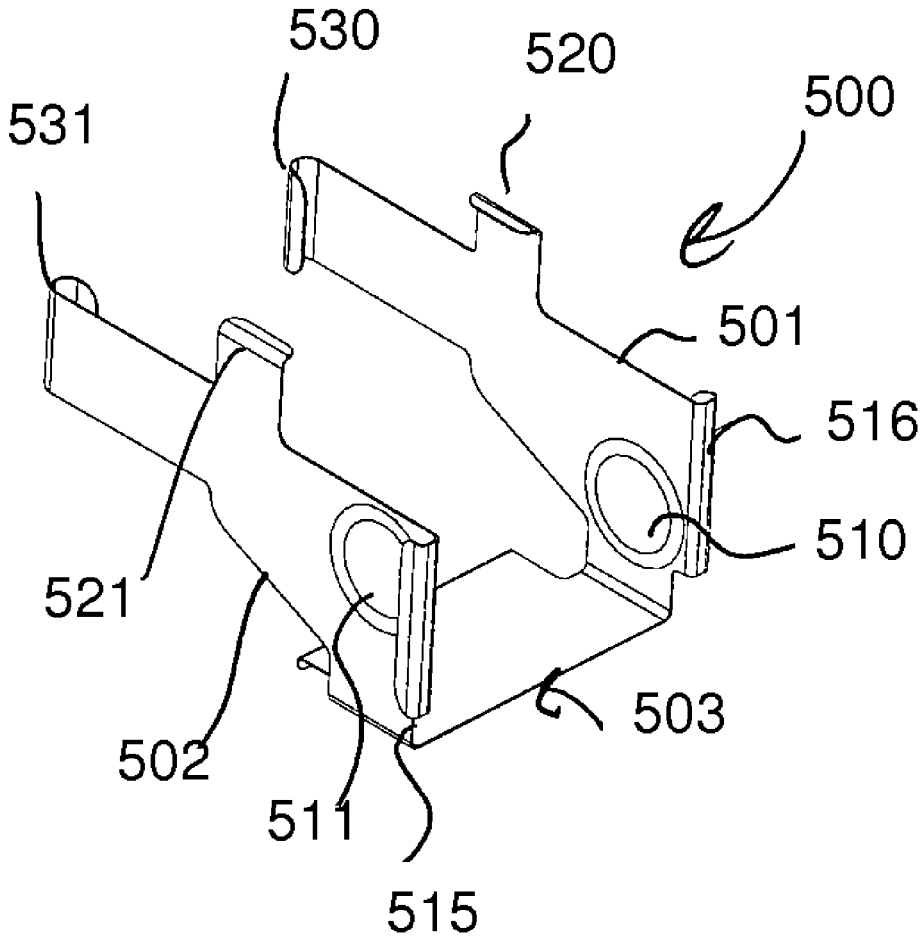
FIG. 4 is a perspective view of an example side contact spring portion.

Reference is now made to FIG. 4, which illustrates an embodiment of the side contact spring portion 500 in greater detail. In the illustrated embodiment, the side contact spring portion 500 is a U-shaped piece of a conductive metal material that includes a first side 501, a second side 502, and a middle portion 503 that is connected to both the first and second sides. This arrangement allows the side contact spring portion 500 to be inserted into the jack 110 and to provide the required electrical ground contact for the shielded plug 300. Of course, one of skill in the art will appreciate that the side contact spring portion 500 need not be a single metal piece as the first and second sides 501 and 502 and the middle portion 503 may be separate pieces. In addition, it will be appreciated that the side contact spring portion 500 need not be a U-shaped piece of a conductive metal material, but may be any other reasonable shape as circumstances warrant. Note that the compression fingers 515 and 516 extend from the front of second and first sides 502 and 501 respectively.

The side contact spring portion 500 also includes a first raised portion or dimple 510 implemented in first side 501 and a second raised portion or dimple 511 implemented in second side 502. As illustrated, the raised portions 510 and 511 are constructed such that they extend from or are raised from the portions of first and second sides 501 and 502 that are adjacent to the middle portion 503, leaving an indention or cavity in the portion of first and second sides 501 and 502 that are not adjacent to the middle portion 503. In this manner, when a plug 300 is inserted into jack 110, the raised portions 510 and 511 will touch the sides of the plug as they extend into the jack 110. In one embodiment, the raised portions 510 and 511 are created by stamping the sides 501 and 502, although other reasonable methods may also be used to create the raised portions.

The side contact spring portion 500 further includes bail contact portions 520 and 530 on first side 501 and bail contact portions 521 and 531 on second side 502. The bail contact portions function to provide connections points between the bail 400 and the side contact spring portion 500. In this way, the side contact spring portion 500 is able to provide a ground to the bail 400 and thus prevent the bail 400 from acting as an antenna that will emit unwanted signals. As is seen in FIG. 5, the bail contact portions 520, 521, 530, and 531 wrap around various portions of the bail 400 while still allowing the bail to move.

Figure 5:
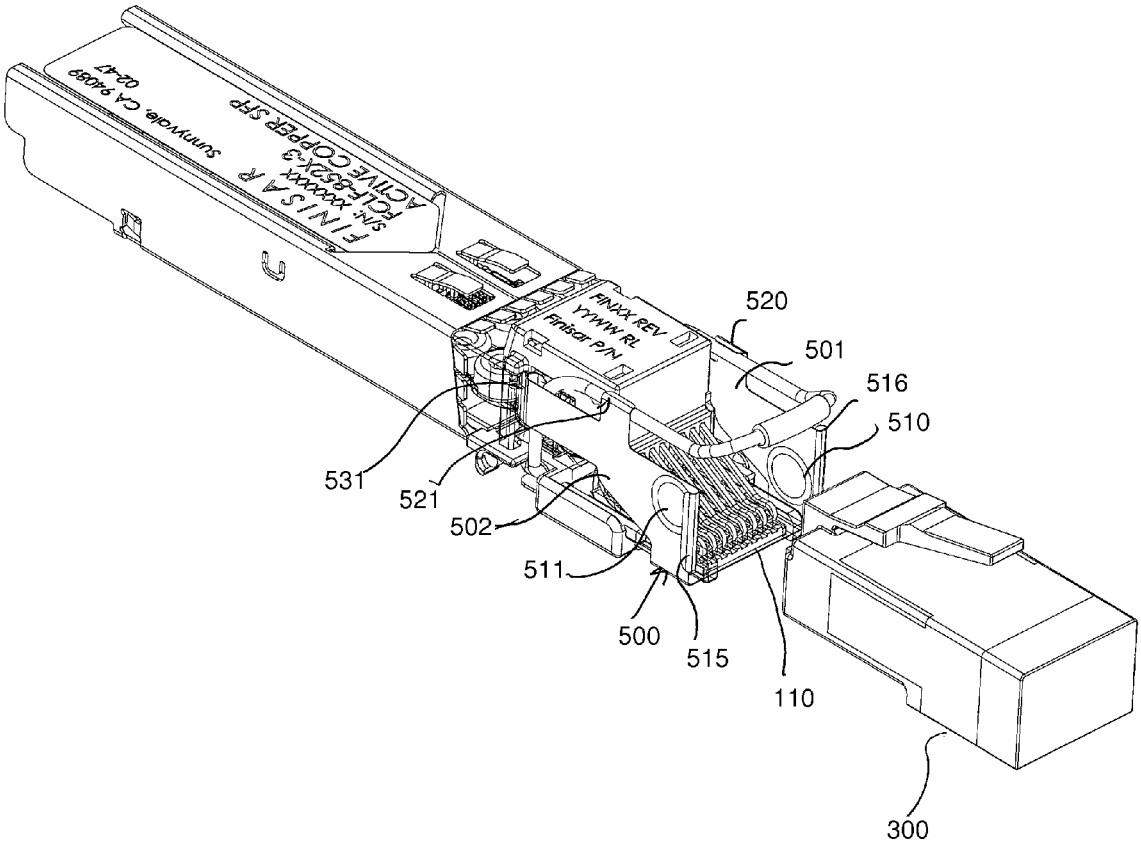
FIG. 5 is a perspective view of the example transceiver module of FIG. 1 implementing the example side contact spring portion of FIG. 4.

Turning now to FIG. 5, the functionality of side contact spring portion 500 will be described in more detail. FIG. 5 shows the module 100 of FIG. 1 with the connector portion 108 removed and also shows an example shielded plug 300. Note that in several of the reference numerals shown in FIG. 1 have been omitted in FIG. 5 to help focus on the side contact spring portion 500.

As shown, a shielded plug 300 may be inserted into the jack 110. When inserted, the raised portions or dimples 510 and 511 provide side electrical contact with side sections of the electrically conductive housing 310 of the shielded plug 300. The compression fingers 515 and 516 are in turn electrically connected to the shell of connector 108 as previously described. The connector portion 108 has an electrical contact to the base 102, the base 102 has a secure electrical contact to the housing 126, and the housing 126 has a secure electrical contact to chassis ground when the transceiver module 100 is plugged into a host device (not shown). Accordingly, the side contact spring portion 500 is configured to provide an efficient ground connection for a plug 300 that is inserted into the jack 110.

Traditional grounding systems provide for contact fingers that are connected to the shell of the module to wrap around the interior of the module jack and to provide contact to an inserted plug such as plug 300. As previously mentioned, however, use of the bail 400 is widespread in latching mechanisms of communication modules. As will be appreciated, the bail 400 must be moved a certain amount for it to function as designed. However, such movement would cause the interior contact fingers of the traditional systems to break off and thus would disrupt the electrical connection between the contact fingers and the inserted plug, thus preventing the traditional methods from providing the necessary grounding for the inserted plug.

The side contact spring portion 500 provides an advantageous solution to this problem commonly found in modules that implement the bail 400. For example, because the side contact spring portion 500 provides contact with the plug 300 through use of the raised portions or dimples 510 and 511. Further, the electrical contact with the connector portion 108 of the body 102 is provided by the contact fingers 515 and 516 that wrap around out of the jack 110. Advantageously, the novel design of side contact spring portion 500 provides for the necessary grounding of the plug 300 while still allowing the bail 400 to function as designed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A transceiver module for use in a communications network, the transceiver module comprising:

a housing operative to be electrically connected to chassis ground when the transceiver module is received within a host port;

a jack defined in the housing and operative to receive a shielded plug; and a side contact spring portion substantially implemented within the jack, wherein the side contact spring portion is configured to be in electrical contact with both the housing and a conductive element of the shielded plug received by the jack such that a chassis ground is established between the housing and the shielded plug and such that a moveable bail pivot lever connected to a locking member and configured to allow the removal of the transceiver module from within the host port is able to move without disrupting the electrical contact between the side contact spring portion and the housing and/or the conductive element of the shielded plug, wherein the side contact spring portion includes one or more raised portions or dimples, wherein the one or more raised portions or dimples are configured to bias against a shielded plug when the shielded plug is received by the jack, and wherein the side contact spring portion includes one or more compression fingers configured to be in direct contact with the housing and wherein the one or more raised portions or dimples are configured to be in direct contact with the conductive element of the shielded plug received by the jack.

2. The transceiver module as recited in claim 1, wherein the transceiver module substantially conforms to the SFP Transceiver MSA.

3. The transceiver module as recited in claim 1, wherein the transceiver module is configured to achieve data rates of about 1.25 Gb/s.

4. The transceiver module as recited in claim 1, wherein the transceiver module substantially supports the 1000Base-T transmission standard.

5. The transceiver module as recited in claim 1, wherein the transceiver module is configured to operate between about −40° C. and 85° C.

6. The transceiver module as recited in claim 1, wherein the jack substantially conforms to a RJ-45 standard.

7. The transceiver module as recited in claim 1, wherein the jack is operative to receive a shielded plug that substantially conforms to a RJ-45 standard.

8. The transceiver module as recited in claim 1, wherein the housing includes a locking recess which is sized and shaped to expose a lock pin of the locking member.

9. A transceiver module comprising:

a housing comprising electrically conductive material;

a jack defined in the housing, the jack being configured to receive a shielded plug;

a wire bail at least partially enclosed in the housing; and a side contact spring portion substantially implemented within the jack, wherein the side contact spring portion is configured to electrically connect with the housing, the wire bail, and the shielded plug that is received within the jack, wherein the side contact spring portion includes one or more compression fingers configured to be in direct contact with the housing, one or more raised portions or dimples configured to be in direct contact with a conductive element of the shielded plug received by the jack, and one or more bail contact portions configured to be in direct contact with the wire bail.

10. The transceiver module as recited in claim 9, wherein the jack substantially conforms to a RJ-45 standard.

11. The transceiver module as recited in claim 9, wherein the transceiver module substantially conforms to the SFP Transceiver MSA.

12. A transceiver module comprising:

a housing comprising electrically conductive material;

a jack defined in the housing, the jack being configured to receive a shielded plug;

a latch mechanism at least partially enclosed within the housing, the latch mechanism comprising:

a mounting plate electrically connected to the housing;

a pivot block pivotally and electrically connected to the mounting plate; and a wire bail operatively and electrically connected to the pivot block plate; and a side contact spring portion substantially implemented within the jack, wherein the side contact spring portion is configured to electrically connect with the housing, the wire bail, and the shielded plug that is received within the jack, wherein the side contact spring portion includes one or more compression fingers configured to be in direct contact with the housing, one or more raised portions or dimples configured to be in direct contact with a conductive element of the shielded plug received by the jack, and one or more bail contact portions configured to be in direct contact with the wire bail.

13. The transceiver module as recited in claim 12, wherein the housing includes a locking recess which is sized and shaped to expose a lock pin of the pivot block when the latch mechanism is in a latched position.

14. The transceiver module as recited in claim 12, wherein the jack substantially conforms with the a RJ-45 standard.

15. The transceiver module as recited in claim 12, wherein the transceiver module substantially conforms to the SFP Transceiver MSA.

* * * * *